US011006757B2

(12) United States Patent
Titayevsky et al.

(10) Patent No.: US 11,006,757 B2
(45) **Date of Patent: *May 18, 2021**

(54) CHIN REST

(71) Applicant: Dr. Cliff's Products, LLC, Pompano Beach, FL (US)

(72) Inventors: Leonard Titayevsky, Fort Lauderdale, FL (US); Clifford Jay Shapiro, Cooper City, FL (US)

(73) Assignee: Dr. Cliff's Products, LLC, Pompano Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/924,997

(22) Filed: Jul. 9, 2020

(65) Prior Publication Data

US 2020/0359800 A1 Nov. 19, 2020

Related U.S. Application Data

(63) Continuation of application No. 16/413,796, filed on May 16, 2019, now Pat. No. 10,736,427.

(51) Int. Cl.
*A47C 7/38* (2006.01)

(52) U.S. Cl.
CPC ..... *A47C 7/383* (2013.01)

(58) Field of Classification Search
USPC ..... 248/118; 128/DIG. 23; 602/18
See application file for complete search history.

(56) References Cited

U.S. PATENT DOCUMENTS

| | | | | |
|---|---|---|---|---|
| 6,231,535 | B1 * | 5/2001 | Mainiero | A47C 7/383 5/636 |
| 6,357,054 | B1 * | 3/2002 | Bainbridge | A41D 13/015 2/455 |
| 6,973,691 | B1 * | 12/2005 | Cordova | A47C 7/383 248/118 |
| 7,055,908 | B1 * | 6/2006 | Williams | A47C 7/383 297/392 |
| 10,736,427 | B1 * | 8/2020 | Titayevsky | A47C 7/383 |
| 2005/0247309 | A1 * | 11/2005 | Reddick | A61F 5/3707 128/200.26 |

* cited by examiner

*Primary Examiner* — Alfred J Wujciak
(74) *Attorney, Agent, or Firm* — The Concept Law Group, PA; Scott M. Garrett; Scott D. Smiley

(57) ABSTRACT

A chin rest includes a body having opposing sides, a front, a back, a top having a top surface, and a bottom having a bottom surface. The top further defines a top plane between a front and back of the top, and the bottom defines a bottom plane between a front of the bottom and a back of the bottom. The top plane and bottom plane form an angle so that the chin rest can comfortable sit between a user's chin and the user's chest, with the user's chin resting on the top surface, and the bottom surface engaged against the user's upper chest. The user's head can be comfortably supported while the user is seated, allowing the user to relax muscles in the neck and avoid strain and other issues normally associated with resting without support in a seated position.

11 Claims, 13 Drawing Sheets

CHIN REST

CROSS REFERENCE

This application is a continuation of U.S. patent application Ser. No. 16/413,796, filed May 16, 2019, titled "Chin Rest," the entirety of which is hereby incorporated by reference.

FIELD OF THE DISCLOSURE

The present disclosure relates generally to personal comfort products, and more particularly to a chin rest product that can be used by a person to stably rest their head when seated, such as on mass transit, and which is simple and inexpensive to produce.

BACKGROUND OF THE DISCLOSURE

When traveling on mass transit such as trains, airlines, and buses, it is not uncommon for a person to want to rest or even sleep. However, people often find it difficult to get into a comfortable position to do so because they are typically seated in an upright position instead of laying down. Furthermore, the spatial constrains on mass transit seating does not lend itself to a comfortable resting position. Worse, when people do manage to fall asleep under these conditions, when they wake up it is not uncommon to have aches due to strained muscles and ligaments dues to falling asleep in an awkward position. For example, a traveler in an airline seat may be limited to simply leaning their head forward, or forward at an angle. If they remain in such a position for a significant period of time, it can result in strain in the upper back and neck, causing pain and discomfort.

This problem has been addressed by a variety of products. One of the more popular of which is the neck pillow. A neck pillow is "U" or broken "O" shaped pillow that a person can place around their neck, and which generally encircles their neck. The bulk provided by neck pillow reduces the degree to which a person's head can lean to either side, thereby allowing the person to relax without placing excessive strain on their neck. These pillows can help alleviate some of the discomfort associated with resting during long transits, but they often do not provide support under the chin so a person using them must lean to the side. Leaning their head forward results in the same effect as occurs without the neck pillow. Some neck pillows address this by having overlapping portions in the front, under the wearer's chin, but these can result in a discontinuity (difference in thickness) that causes the head to be biased to an angle.

Other devices have been developed to fit between a person's head and shoulder or under their chin. An example of which is given in U.S. Published Patent Application No. 2011/0169316, which described a portable headrest that can be placed on either side of a person's head, between their head and shoulder on one side. If the person wants to lean to the other side than the device needs to be repositioned. The device can also be used as a chin rest.

One issue with all of these solutions, however, is that, while moderately priced, they are not something one would want to buy every time they travelled. And many people travel infrequently such that a resting device can become lost or misplaced between the time the person first buys and uses the device to the next time they travel, necessitating the purchase of a new resting device or foregoing a resting device to avoid the expense of buying another.

Therefore, a need exists to overcome the problems with the prior art as discussed above.

SUMMARY OF THE DISCLOSURE

In accordance with some embodiments of the inventive disclosure, there is provided a chin rest including a body having a first side, a second side opposite the first side, a front, and a back. The first side and the second side of the body are each flat, the first side defines a first side plane, and the second side defines a second side plane. The body has a top portion, a bottom portion, and a middle portion joining the top portion and the middle portion. The top portion, bottom portion, and middle portion each extend from the first side plane to the second side plane. The top portion and bottom portion are wider from the front to the back than the middle portion such that the first side plane and the second side plane each have an I-shaped configuration. The body is sized to hold a head of a user of the chin rest in a neutral position while the user is seated and moderately reclined with the top portion under a chin of the user with the chin of the user on the top portion and the bottom portion on an upper chest of the user, with the back facing towards the user, and the front facing away from the user.

In accordance with another feature, the bottom portion defines a bottom surface from the back to the front and from the first side to the second side, the bottom surface being radiused inward to be concave in a direction from the front to the back.

In accordance with another feature, the top portion defines a top surface that is radiused inward to be concave in a direction from the front to the back.

In accordance with another feature, the a top plane is defined over a top surface from the front to the back, a bottom plane is defined over a bottom surface from the front to the back, and the top plane and the bottom plane are angled with respect to each other at substantially 45 degrees.

In accordance with another feature, the body further includes a front transverse channel formed in the front of the body from the first side to the second side across the middle portion.

In accordance with another feature, the body further includes a back transverse channel formed in the back of the body from the first side to the second side across the middle portion.

In accordance with another feature, the chin rest is made of a compliant material.

In accordance with another feature, the chin rest is made of a semi-rigid material.

In accordance with another feature, the semi-rigid material is a closed cell polystyrene material.

In accordance with another feature, the front of the chin rest is flat across an entirety of the front, in a direction from the first side plane to the second side plane and is not flat across the front in a direction from the top portion to the bottom portion.

In accordance with another feature, the front of the chin rest is flat across an entirety of the back, in a direction from the first side plane to the second side plane and is not flat across the back in a direction from the top portion to the bottom portion.

In accordance with some embodiments of the inventive disclosure, there is provided a chin rest that includes a unitary body having a first side defining a first side plane, a second side opposite the first side and defining a second side plane, a front defined from the first side plane to the second side plane, and a back opposite the front defined from the first side plane to the second side plane. The unitary body further includes a bottom portion at a bottom of the unitary body. The bottom portion has a bottom surface extending from the first side plane to the second side plane, a front bottom corner defined where the bottom transitions to the front across the unitary body from the first side to the second side, a back bottom corner defined where the bottom transitions to the back across the unitary body from the first side to the second side, and a bottom plane defined between front bottom corner and the back bottom corner. The unitary body further includes a top portion at a top of the unitary body. The top portion has a top surface extending from the first side plane to the second side plane, a front top corner defined where the top transitions to the front across the unitary body from the first side to the second side, a back top corner defined where the top transitions to the back across the unitary body from the first side to the second side, and a top plane defined between front bottom corner and the back bottom corner. The unitary body further includes a middle portion joining the bottom portion and the top portion and which extends from the first side to the second side. The top and the bottom portions are wider, from the front to the back, than the middle portion. A distance between the back top corner and the back bottom corner is less than a distance between the front top corner and the front bottom corner. The unitary body is sized to hold a head a user in a neutral position while the user is seated and moderately reclined with the top portion under a chin of the user with the chin of the user on the top portion and the bottom portion on an upper chest of the user, with the back facing towards the user, the front facing away from the user.

In accordance with a further feature, the top plane and the bottom plane are at an angle of substantially forty five degrees with respect to each other.

In accordance with a further feature, the bottom surface includes a concave portion, in a direction from the front to the back.

In accordance with a further feature, the back top corner is rounded, and curves inward towards the front along an arc between the first side and the second side.

In accordance with a further feature, the first side and second side each have an I-shaped configuration.

In accordance with a further feature, the unitary body is made of a semi-rigid material.

In accordance with a further feature, the semi-rigid material is a closed cell polystyrene material.

In accordance with a further feature, the unitary body is made of a compliant material.

Other features that are considered as characteristic for the disclosure are set forth in the appended claims. As required, detailed embodiments of the present disclosure are disclosed herein; however, it is to be understood that the disclosed embodiments are merely exemplary of the disclosure, which can be embodied in various forms. Therefore, specific structural and functional details disclosed herein are not to be interpreted as limiting, but merely as a basis for the claims and as a representative basis for teaching one of ordinary skill in the art to variously employ the present disclosure in virtually any appropriately detailed structure. Further, the terms and phrases used herein are not intended to be limiting; but rather, to provide an understandable description of the disclosure. While the specification concludes with claims defining the features of the disclosure that are regarded as novel, it is believed that the disclosure will be better understood from a consideration of the following description in conjunction with the drawing figures, in which like reference numerals are carried forward. The figures of the drawings are not drawn to scale.

Before the present disclosure is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present disclosure, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present disclosure and simplify the description, but not to indicate or imply that the devices or components must have a specific azimuth, or be constructed or operated in the specific azimuth, which thus cannot be understood as a limitation to the embodiments of the present disclosure. Furthermore, terms such as "first", "second", "third" and so on are only used for descriptive purposes, and cannot be construed as indicating or implying relative importance.

In the description of the embodiments of the present disclosure, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present disclosure according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present disclosure.

DETAILED DESCRIPTION

Figure 1:
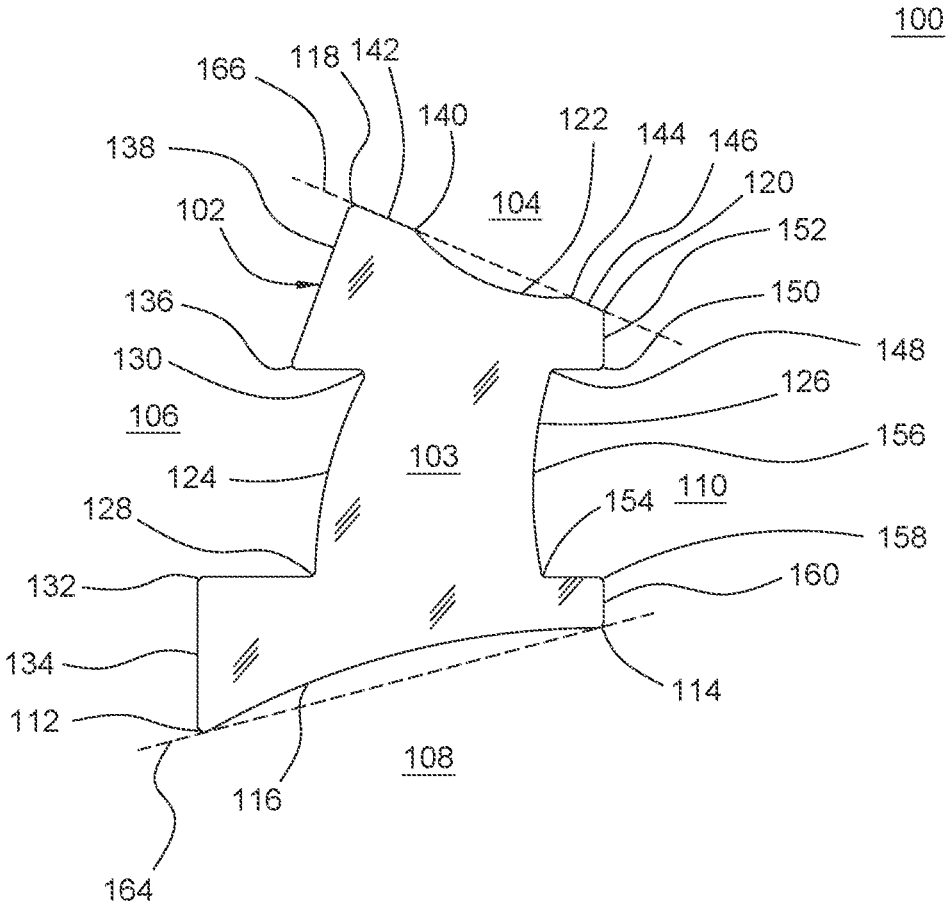
FIG. 1 is a first or left side elevational view of a chin rest, in accordance with some embodiments.

While the specification concludes with claims defining the features of the disclosure that are regarded as novel, it is believed that the disclosure will be better understood from a consideration of the following description in conjunction with the drawing figures, in which like reference numerals are carried forward. It is to be understood that the disclosed embodiments are merely exemplary of the disclosure, which can be embodied in various forms.

The present disclosure provides a novel and efficient chin rest useful to support a user's head while in a seated position. In particular, the chin rest can be placed between the user's lower jaw, under the user's chin, and the user's upper chest region. By supporting the user's head, the user's neck can be relaxed, thereby avoiding strain and discomfort that would otherwise be experienced.

Figure 2:
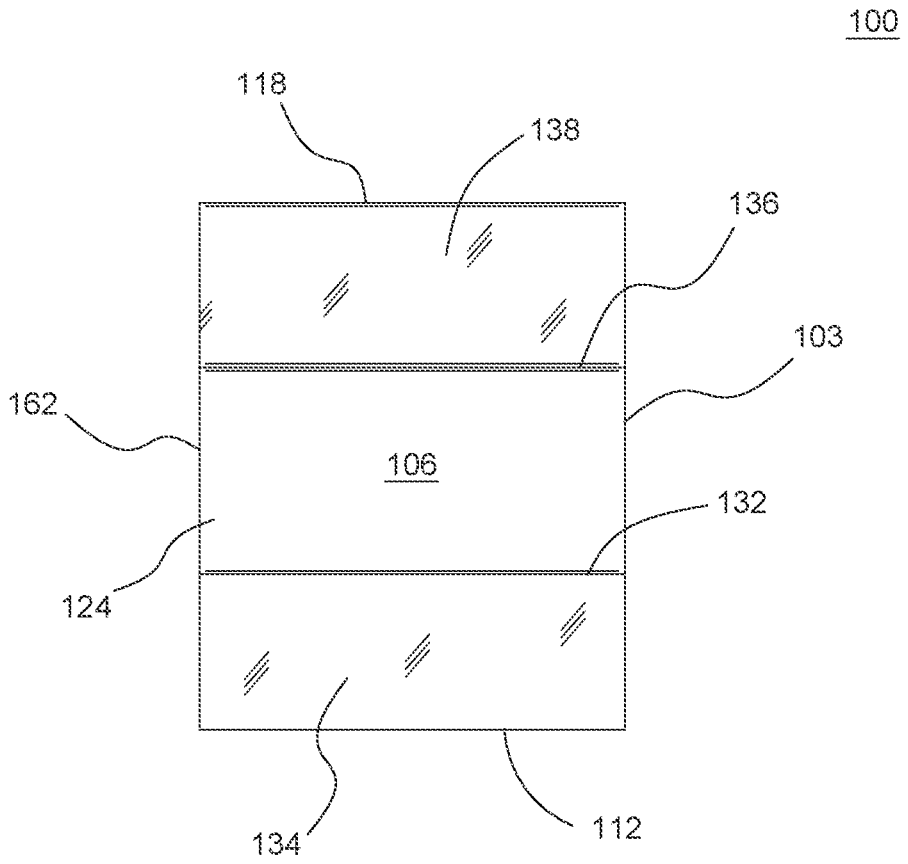
FIG. 2 is a front elevational view of a chin rest as shown in FIG. 1, in accordance with some embodiments.
Figure 3:
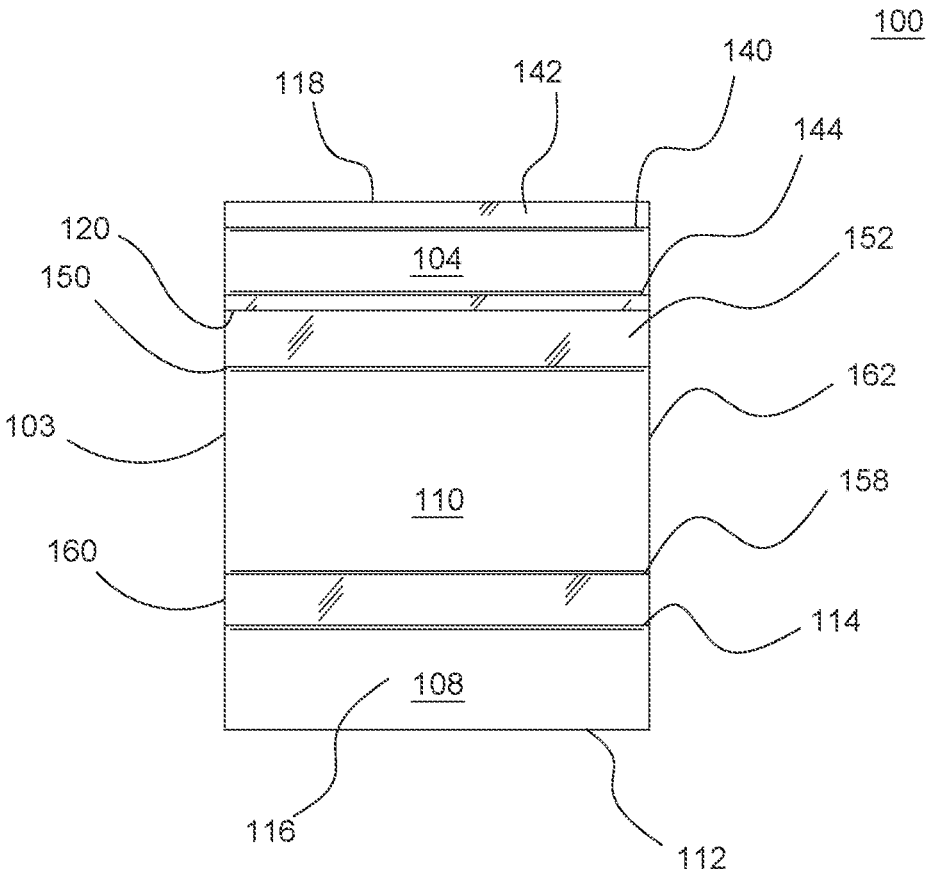
FIG. 3 is a back or rear elevational view of a chin rest as shown in FIG. 1, in accordance with some embodiments.
Figure 4:
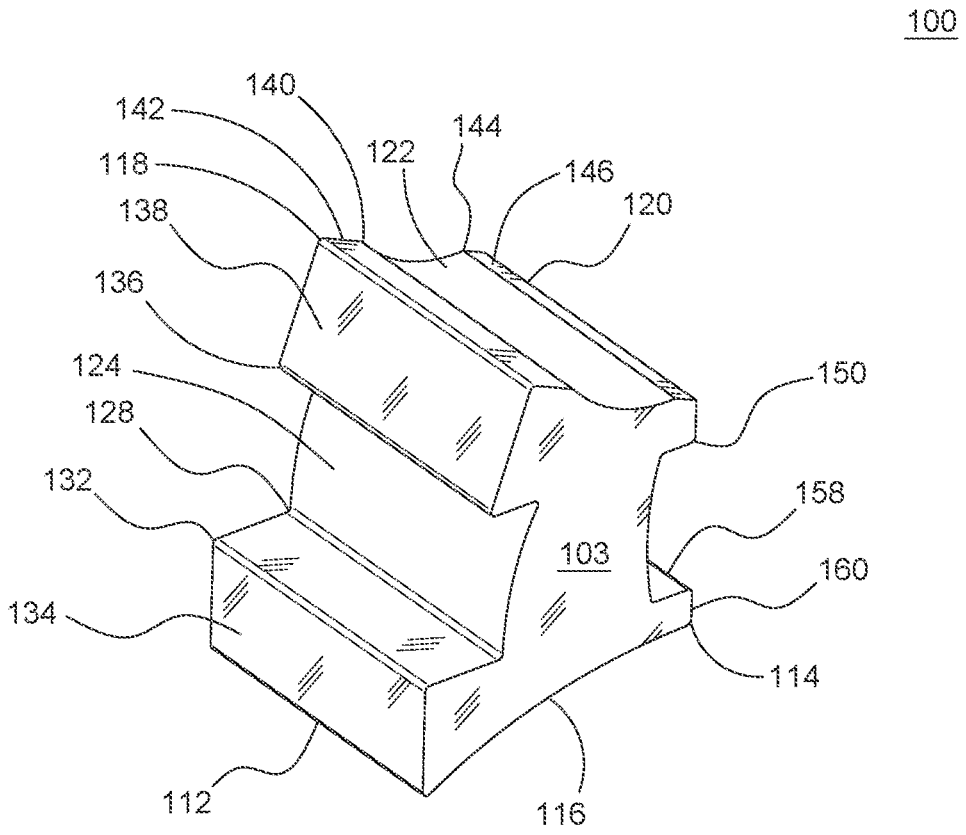
FIG. 4 is a upper left perspective view of a chin rest as shown in FIG. 1, in accordance with some embodiments.
Figure 5:
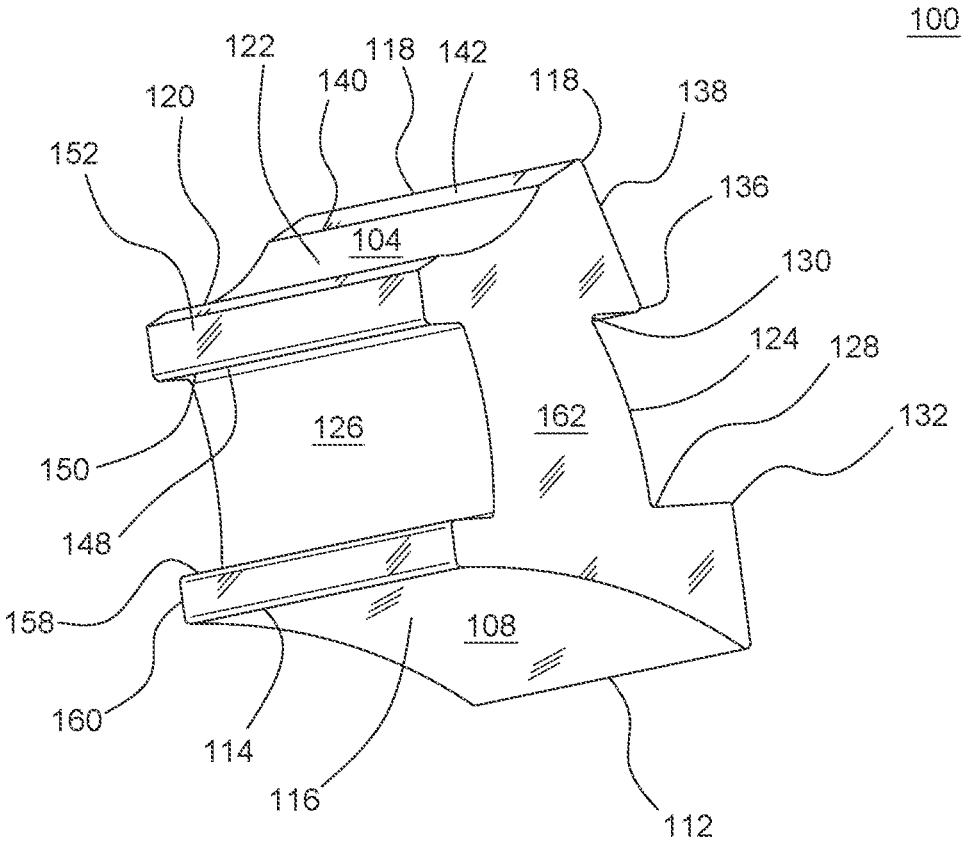
FIG. 5 is a lower right perspective view of a chin rest as shown in FIG. 1, in accordance with some embodiments.

FIG. 1 is a first, or left side elevational view of a chin rest 100, in accordance with some embodiments. The chin rest 100 is further shown in FIGS. 2-5. FIG. 2 is a front elevational view, FIG. 3 is a back or rear elevational view, FIG. 4 is an upper left perspective view, and FIG. 5 is a lower right perspective view of the chin rest 100. Generally the chin rest is a unitary chin rest, meaning it is formed as a whole unit out of a material, as opposed to being formed as different parts that are assembled or joined together, which allows for inexpensive manufacturing. In some embodiments, the chin rest 100 can be formed by cutting a continuously formed extrusion at a desired width (i.e. from side to side). The chin rest 100 can be made with a variety of materials, from compliant, slightly compressible material to rigid material that can be covered with padding, or left uncovered. In some embodiments the chin rest 100 can be made of a closed cell polystyrene material.

Referring generally, then, to FIGS. 1-5, the chin rest 100 comprises a body 102 generally having a first side 103 and a second side 162 which oppose each other. The first and second sides 103, 162 can be substantially flat and planar (e.g. coplanar with the page in FIG. 1 and orthogonal to the page in FIGS. 2-3). The body further has a front 106, and back 110, a top portion 104, and a bottom portion 108 and a middle portion 156 between and joining the top portion 104 and the bottom portion 108. The top portion 104 is defined between a front top corner or edge 110 and back top corner or edge 120. A top plane 166 can be defined between the front top edge 118 and the back top edge 120 that is orthogonal to the planes of the first and second side 103, 162. Likewise, a bottom plane 164, defined between the bottom front edge 112 and the bottom back edge 114 is orthogonal to the planes of the first and second side 103, 162, but not parallel to the top plane 166. Thus, in some embodiments, the body 102 can generally be formed as a six sided prism where the planes of the first and second side 103, 162 are parallel, and orthogonal to the bottom and top planes 164, 166. The front 106 and back 110 can include features that deviate from, for example, a line between the bottom front edge 112 and the top front edge 118 for the front 106, and the back bottom edge 114 and top back edge 120 for the back, but the front 106 and back 110 can be flat along any line across the front or the back, from the first side 103 to the second side 162 that is orthogonal to the planes of the first and second sides 103, 162. In some embodiments, the bottom plane 164 and top plane 166 can be angled with respect to each other at an angle of forty to fifty degrees, and in some embodiments at an angle of about forty five degrees. The angle is formed by the back top edge 120 being closer to the back bottom edge 114 than the front top edge 118 is to the front bottom edge 112. Each of the front top edge 110, back top edge 120, front bottom edge 112, and back bottom edge 114 can be rounded corners, equivalently, as desired for comfort when using the chin rest 100. Furthermore, as used herein, the term "front top" is interchangeable with "top front," and likewise for "back top"/"top back," "front bottom"/"bottom front," and "back bottom"/"bottom back." These terms are refer to respective transition features between the front and back and the top and bottom, as will be readily understood by those skilled in the art.

The top portion 104 includes a top surface 122 that can be concave, and radiused inward with respect to the top plane 166. This provides a depression in the top surface 122 that acts as a position for a user's chin. The curvature of the concave portion of the top surface 122 can have a radius of 0.75"-1.25". Similarly, the bottom portion 108 can include a bottom surface 116 between the front bottom edge 112 and the back bottom edge 114 that is concave and radiused inward with respect to the bottom plane 164. The bottom surface 116 can be made concave in order to accommodate the upper chest of the user when the chin rest is in use, and placed between the user's chin and upper chest. The curvature of the bottom surface 116 can have a radius of 4"-5".

As used here, the term "radiused inward" means that, generally, the surface (bottom surface 116 or top surface 122) deviates from its respective plane (bottom plane 164 or top plane 166) inward towards the interior of the body 102 along an arc. In some embodiments, the top surface 122 and bottom surface can be flat, meaning linear, or straight, in a direction from the first side 103 to the second side 162 that is orthogonal to both the first and second sides 103, 162. The top surface 122 as shown here is not flat going from the top front edge 118 and the top back edge 120; which is a direction parallel to the planes of the first and second sides 103, 162. Likewise, the bottom surface 116 is not flat in a direction from the bottom front edge 112 to the bottom back edge 114, but is "flat," along a line normal to the first side 103 to the second side 162. As will be shown, in some embodiments, the flatness, or linear-ness, from side to side, allows the chin rest to be easily manufactured. In some embodiments, however, it is contemplated that the top and bottom surfaces 122, 116 can be contoured, and not flat from the first side 103 to the second side 162. Likewise, it is further contemplated that the first side 103 and second side 162 may be contoured, and not flat, in some embodiments, for aesthetic reasons.

In some embodiments, the top portion 104 can include planar front and back surface portions 142, 146, respectively. The planar front surface portion 142 is defined between the front top edge 118 and a front top interior line 140 that is parallel to the front top edge 118. The planar back surface portion 146 is defined between the back top edge 120 and a back top interior line 144 that is parallel to the back top edge 120 (and the front top edge 118 and front top interior line 140). The concave portion of the top surface 122 is formed between the front top interior line 140 and the back top interior line 144 between (from front 106 to back 110 of the body 102) the planar front surface portion 142 and the planar back surface portion 146, which can help a person locate the concave region with the chin for optimum resting position.

Across the front 106 there can be a front transverse channel 124 formed between a front top shoulder and a front bottom shoulder which extends across the entirety of the front, from the first side to the second side. The front top shoulder is formed by an inward deviation from a front top surface 138 defined between the front top edge 118 and a front top exterior shoulder line 136. The deviation defining the front top shoulder extends from the front top exterior shoulder line 136 to a front top interior shoulder line 130. The front bottom shoulder is formed by an inward deviation from a front bottom surface 134 that is defined between the front bottom edge 112 and a front bottom exterior shoulder line 132. The deviation defining the front bottom shoulder extends from the front bottom exterior shoulder line 132 to a front bottom interior shoulder line 128. The interior surface of the front transverse channel 124, between the front top interior shoulder line 130 and the front bottom interior shoulder line 128, can be convex between the front top interior shoulder line 130 and the front bottom interior shoulder line 128, such that the interior surface curves outward between the front top interior shoulder line 130 and the front bottom interior shoulder line 128 in a direction parallel to the planes of the first and second sides 103, 162. The front transverse channel 124 can accommodate, for example, a strap or straps of a neck pillow that can help retain the chin rest 100 in position under the user's chin when being used. The upper and lower shoulders, between front top exterior/interior shoulder lines 136, 130, respectively, and the front bottom exterior/interior lines 132, 128, respectively, prevent any straps or other retaining elements from slipping off the chin rest 100.

Across the back 110 there can be a back transverse channel 126 formed between a back top shoulder and a back bottom shoulder. The back top shoulder is formed by an inward deviation from a back top surface 152 defined between the back top edge 120 and a back top exterior shoulder line 150. The deviation extends from the back top exterior shoulder line 150 to a back top interior shoulder line 148. The back bottom shoulder is formed by an inward deviation from a back bottom surface 160 defined between the back bottom edge 114 and a back bottom exterior shoulder line 158. The deviation extends from the back bottom exterior shoulder line 158 to a back bottom interior shoulder line 154. The interior surface of the back transverse channel, between the back bottom interior shoulder line 154 and the back top interior shoulder line 148, can be concave between the back bottom interior shoulder line 154 and the back top interior shoulder line 148, such that the interior surface of the back transverse channel curves inward between the back bottom interior shoulder line 154 and the back top interior shoulder line 148 in a direction parallel to the planes of the first and second sides 103, 162. The back transverse channel 126 is designed to provide space to accommodate, for example, the laryngeal prominence (Adam's Apple) of the user, as well as any straps, scarves, or other neckwear that a user may be wearing.

In some embodiments the chin rest 100 can have a width, from the first side 103 to the second side 162, of about 3"-3.5", and in some embodiments the width can be 3.25". In some embodiments, the distance from the front bottom edge 112 to the front top edge 118 can be 4"-5" and have a height, measured from the front bottom edge 112 upwards along a line parallel to front bottom surface 134, to a level even with the front top edge 118, of about 4". At the back 110, from the back bottom edge 114 to the back top edge 120 can be about 2"-2.5". In some embodiments the distance between the back top exterior shoulder line 150 and the back lower exterior shoulder line 158 can be about 1"-1.5". In some embodiments the distance from the front top edge 118 to the back top edge 120 can be 2"-3". In some embodiments these dimensions can be proportionately scaled down to create a chin rest for smaller people and children.

Figure 6:
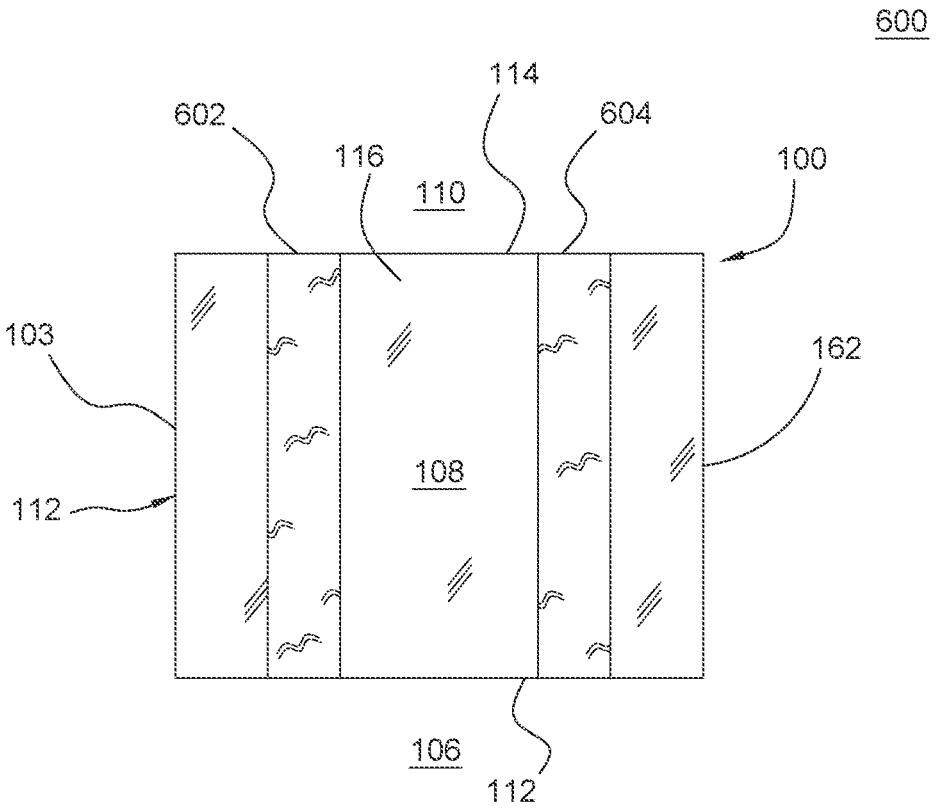
FIG. 6 is bottom plan view of a chin rest as shown in FIG. 1, including frictional engagement strip surfaces, in accordance with some embodiments.

FIG. 6 is bottom plan view 600 of a chin rest 100 as shown in FIG. 1, including frictional engagement strip surfaces 602, 604, in accordance with some embodiments. In some embodiments it is contemplated that, depending on the material that the body 102 of the chin rest 100 is made of, it can be desirable to include a material with a higher coefficient of friction than the material of the body 102. For example the frictional engagement strips 602, 604 can be made of a rubber compound and adhered to the bottom surface 116 of the bottom portion 108 of the body 102. As shown here, the frictional engagement strips 602, 604 extend from the front bottom edge 112 to the back bottom edge 114. Alternatively, or in addition, there can be frictional engagement material such as the frictional engagement strips 602, 604 extending from the first side 103 to the second side 162. In some embodiments the entire bottom surface 116 can be covered with a frictional material. As used here, "frictional material" refers to material with a higher coefficient of friction than the material of the body 102.

Figure 7:
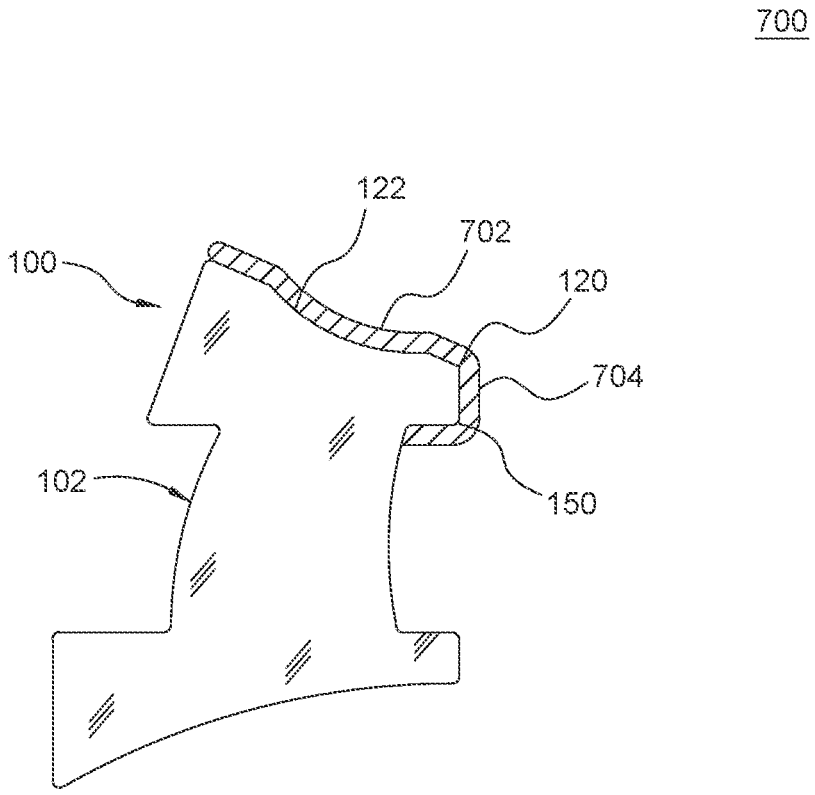
FIG. 7 is a left side elevational view of a chin rest including a chin pad, in accordance with some embodiments.

FIG. 7 is a left side elevational view 700 of a chin rest 100 including a chin pad 702, in accordance with some embodiments. In some embodiments it is contemplated that a compliant chin pad 702 can be attached or otherwise provided to cover the top surface 122. The chin pad 702 can provide comfort and conform to a shape of the user's chin when the user's chin is rested in the chin pad 702. In some embodiments the chin pad 702 can be adhered or glued onto the top surface 122. In some embodiments the chin pad 702 can be a clip on structure that can engage the back upper shoulder or the front upper shoulder, or both. For example, a portion 704 of the chin pad 702 can engage the back of the chin rest 100 between the back upper edge 120 and the back upper exterior shoulder line 150 to hold the chin pad 702 in place while the chin rest 100 is in use.

Figure 8:
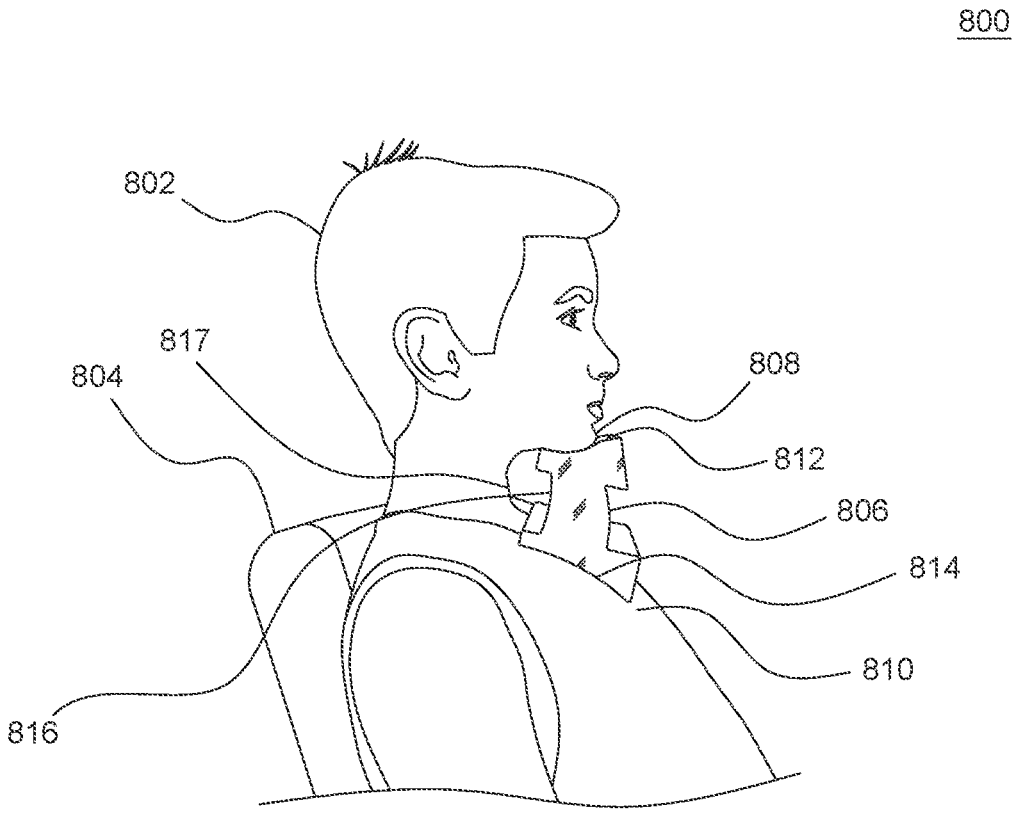
FIG. 8 shows a side view of a person using a chin rest in a seated position, in accordance with some embodiments.

FIG. 8 shows a side view 800 of a person 802 using a chin rest 806 in a seated position, in accordance with some embodiments. The user 802 is sitting in a chair 804, such as a chair or seat of an airplane. The user 802 is using the chin rest 806 between the user's chin 808 and upper chest 810 to support the weight of the head of the user 802 without straining the muscles in the user's neck. The chin rest 806 can be substantially similar to that of FIGS. 1-5, or equivalent. A top surface 812 is in contact with the user's chin, and in particular, the underside of the user's lower jaw, the chin being the forward portion of the user's lower jaw. The bottom surface 814 is in contact with the user's upper chest 810. Thus, when in use, the chin rest 806 can support the user's head in a comfortable position that does not strain or stress, the muscles/tendons in the user's neck. It has been found that most people prefer to recline their chair such that their upper chest is sloped at about a 45° angle. The chin rest 806 is configured such that the top surface 812 and bottom surface 814 are at a similar angle, which allows the head to rest neutrally when the user 802 is using the chin rest 806 when resting comfortably in the chair 804. Furthermore, from this view, it can be seen that the back transverse channel 816 provides room to accommodate the user's Adam's Apple 817, along with any neckwear (scarves, ties, collars, etc.) may have on.

Figure 9:
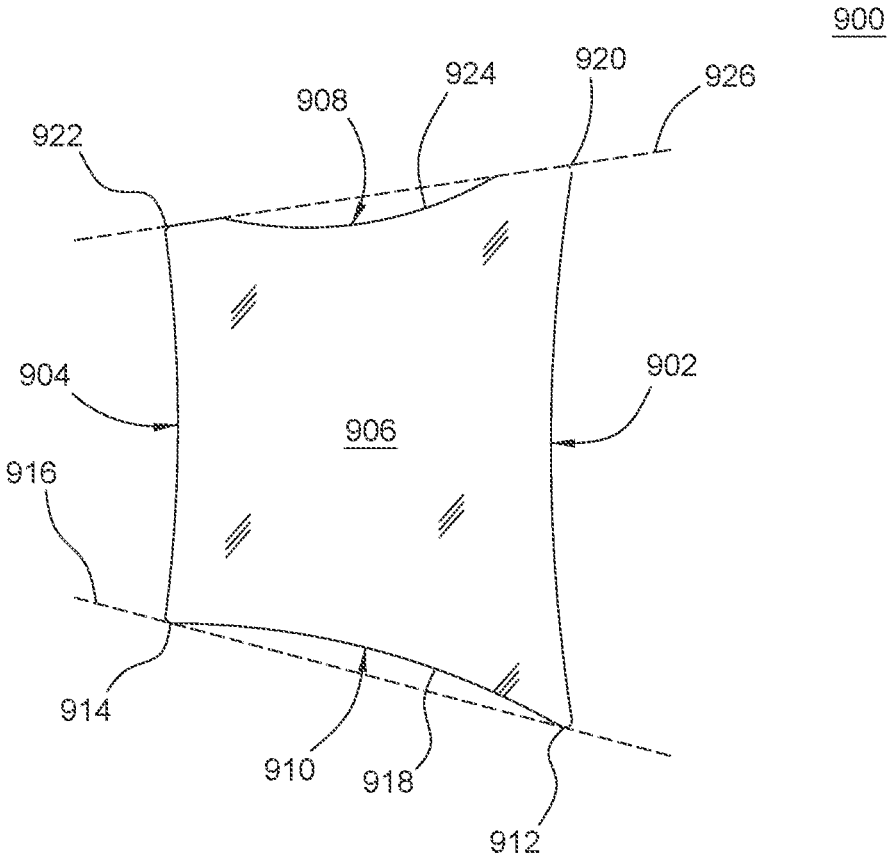
FIG. 9 is a right side elevational view of a chin rest, in accordance with some embodiments.

FIG. 9 is a right side elevational view of a chin rest 900 in accordance with some embodiments. The chin rest 900 is similar to that of FIGS. 1-5, but is configured differently. The chin rest 900 includes a front 902, a back 904, and a right side 906 that is opposite a left side (behind the right side 906 and behind the page). The chin rest 900 further includes a top portion 908 and a bottom portion 910. The top portion 908 includes a top surface 924 between a front top edge 920 and a back top edge 922. The top surface 924 can be concave and radiused inward with respect to a top plane 926 defined between the front top edge 920 and back top edge 922. The bottom portion 910 has a bottom surface 918 that can be concave and radiused inward from a bottom plane 916 defined between the front bottom edge 912 and back bottom edge 914. The back 904 and likewise be concave between the back bottom edge 914 and the back top edge 922 to accommodate neckwear a user may have on. The chin rest 900, as shown here, lacks a front transverse channel. The chin rest 900 is an example of an alternative embodiment that is not exactly shaped like that of chin rest 100 of FIGS. 1-5, but which functions equivalently for the same purpose in most regards. Other variations will occur to those skilled in the art that are likewise obvious variations and which differ insubstantially in one or more dimensions and/or contours or shapes.

Figure 10:
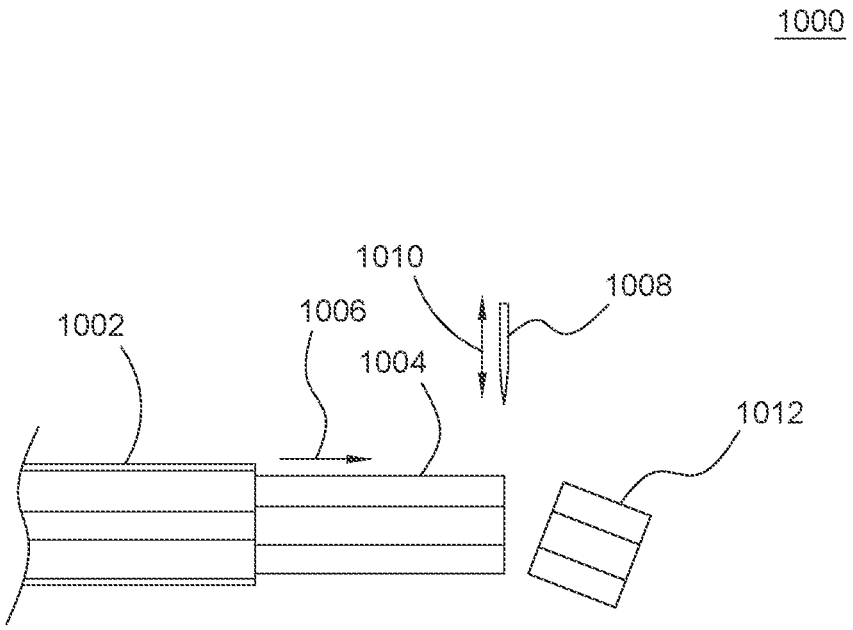
FIG. 10 is view of a machine for producing an extruded form that is cut into individual chin rests, in accordance with some embodiments.

FIG. 10 is view of a machine 1000 for producing an extruded form 1004 that is cut into individual chin rests, in accordance with some embodiments. A curing tube 1002 can have a cross sectional profile that, for example, is identical to the outline the first side 103 of the chin rest 100 of FIGS. 1-5. A heated material, or a mixture of materials can be fed into the curing tube 1002 from the left and the material can cure in the curing tube 1002, which acts as a mold. Once the material is cured, the extrusion 1004 can be pushed out of the curing tube 1002 in the direction of arrow 1006. As the extrusion 1004 is moving out of the curing tube 1002, and blade or other cutting tool 1008 can reciprocate up and down, as indicated by arrow 1010, to cut off a section of the cured extrusion 1004 to form a singulated chin rest 1012. As the cured extrusion 1004 is moved, the tool 1008 can cut off another chin rest. In some embodiments, the cutting tool 1008 can be a hot knife that melts through the material 1004 to seal the sides of each chin rest produced. In some embodiments a rectangular block of material can be pushed through the tube 1002 to cut the block of material in the profile of a chin rest, producing a cutting instead of an extrusion 1004 that is otherwise equivalent to the extrusion 1004 and which can be vertically cut by a tool 1008. Thus, the side profile of the chin rest allows to be manufactured as a unitary device, without need for assembly, without the need to mold separate parts, which requires separate mold tools, and so on. In some embodiments, addition components such as a pad or cover can be added. The material can be a closed cell polystyrene material. In other embodiments, a plurality of chin rests can be produced by wire cutting a large block of material into panels, then cutting the various front and back features (e.g. the front and back transverse channels, shoulders, etc.) and then cutting the panels into posts to form first and second sides, and then cutting the posts to form the top and bottom features of each individual chin rest. Once a chin rest is produced, one or more pads or covering elements can be added to the chin rest. In some embodiments a chin rest can be completely covered in a jacket or covering.

Thus, chin rests can be mass produced in this manner by virtue of their shape, and in particular their side profile. That is, by making the first and second sides 103, 162 flat and parallel, and making the top 104, front 106, bottom 108, and back 110 straight/flat from the first side 103 to the second side 162, the chin rest 100 can be mass produced in the manner shown in FIG. 10, or an equivalent manner. As a result, the chin rest can be manufactured very inexpensively. In fact, they can be made out of recyclable or recompostable material, and can be sold at a low enough cost to be effectively a single use device. A user can purchase a chin rest, or be provided with one, prior to travel, and then deposit it in a designated receptacle after travel so the chin rest can be recycled. Alternatively, the chin rest can be fabricated out of a more robust, durable material intended to be reused for future travel or similar applications. In some embodiments the chin rest can be produced using injection molding, for example.

Figure 11:
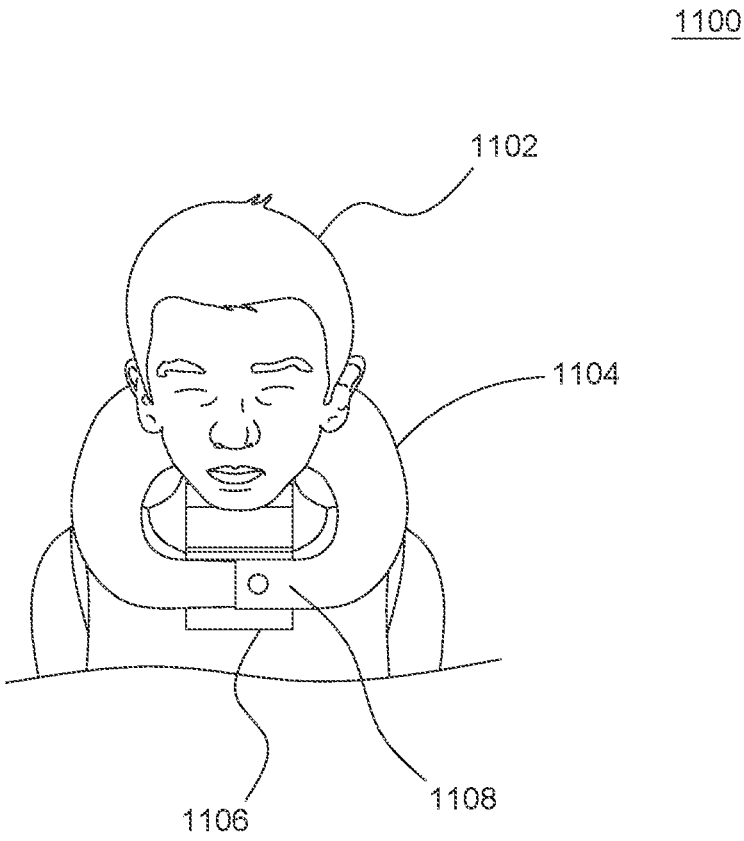
FIG. 11 is a front view of a person using a chin rest in conjunction with a neck pillow, in accordance with some embodiments.

FIG. 11 is a front view 1100 of a person 1102 using a chin rest 1106 in conjunction with a neck pillow 1104, in accordance with some embodiments. The chin rest 1106 can be substantially similar to chin rest 100 of FIGS. 1-5, and when used, provides support for the user's head, from forward to back. However, for side to side support, a neck pillow 1104 can be used to keep the user's head upright. The neck pillow can have a strap system 1108 that couples opposite sides of the neck pillow together in front of the user's neck. As shown here, however the strap system can be connected in front of the chin rest 1106, with the straps retained in a front transverse channel of the chin rest 1106. Once secured, the person 1102 can substantially relax their neck muscles having their head supported in all directions by the combination of the neck pillow 1104 and the chin rest 1106.

Figure 12:
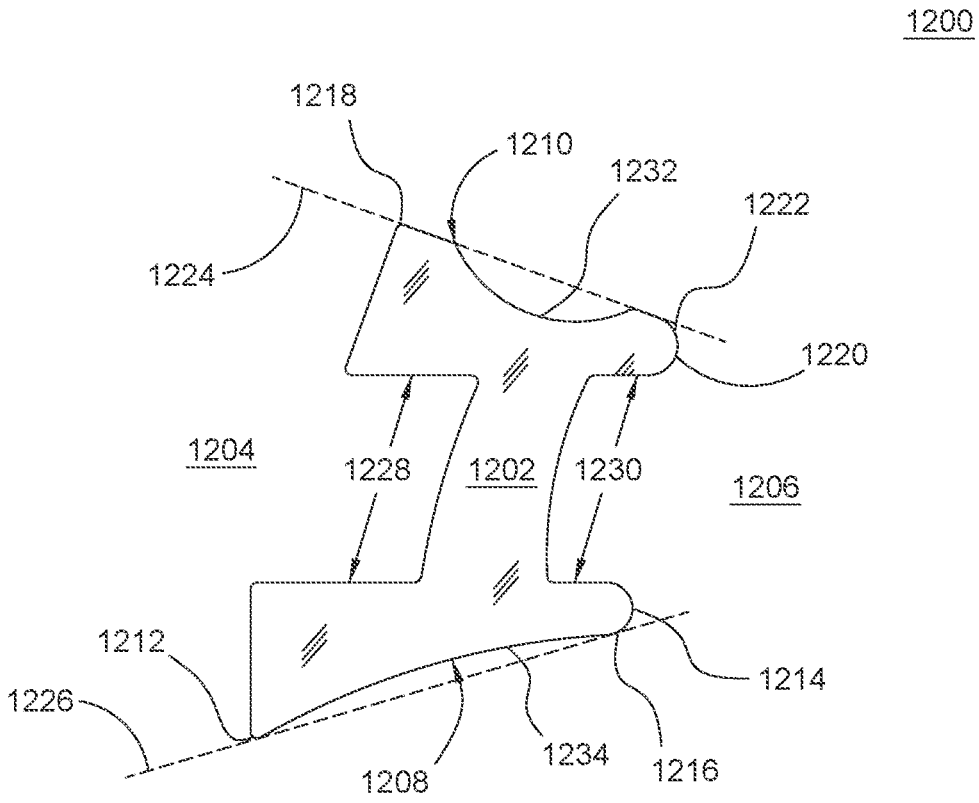
FIG. 12 is a side elevational view of a chin rest having rounded corners, in accordance with some embodiments.

FIG. 12 is a side elevational view of a chin rest 1200 having rounded corners, in accordance with some embodiments. In the chin rest of FIGS. 1-5, the corners where the top surface transitions to the front at the top front edge and the back at the top back edge, and where the bottom surface transitions to the front and back along the front bottom edge and the back bottom edge, are relatively abrupt, hence the term "edge." However, these transitions or corners can also be formed in a rounded configuration.

Chin rest 1200 is substantially similar to that of FIGS. 1-5 having a body 1202, a front 1204, a back 1206, a bottom 1208, and a top 1210. The bottom 1208 includes a bottom surface 1234 between a front bottom corner or edge 1212, and a rounded back bottom corner 1214. A bottom plane 1226 is defined from the front bottom edge 1212 to the back bottom corner 1216 at a transition 1216 where the bottom 1208 transitions to the back 1206 around the corner 1214. As previous examples, the front bottom edge extends across the front, from the first side to the second side, and likewise for all other surfaces along the front 1204, back 1206, bottom 1208, and top 1210. A top plane 1224 is defined from the front top corner or edge 1218 to the back top corner 1220 where the top 1210 transitions to the back 1206. The top plane 1224 and the bottom plane 1226 are angled with respect to each other at approximately 45 degrees, and up to 20 degrees deviation in some embodiments. Thus, an approximation of 45 degrees here is understood to be within a range of about 25 degrees to 65 degrees. The top surface 1232 and the bottom surface 1234 can be concave, deviating inward from the top plane 1224 and bottom plane 1226, respectively.

The front 1204 can include a front transverse channel 1228 between a front top shoulder and a front bottom shoulder, and the back can includes a back transverse channel 1230 between a back top shoulder and a back bottom shoulder. The front transverse channel 1228 can accommodate, for example, the ends of an annular neck pillow that can be used in conjunction with the chin rest 1200 as shown in FIG. 11. The back transverse channel can provide relief for neckwear (e.g. a tie, scarf) as well as the front portion of the user's neck. The back top corner 1222 and back bottom corner 1214 are more rounded compared to the chin rest of FIGS. 1-5, lacking a planar surface at the back, to provide a comfortable structure for use. The front bottom edge 1212 and front top edge 1218 can likewise be rounded corners, equivalently.

Figure 13:
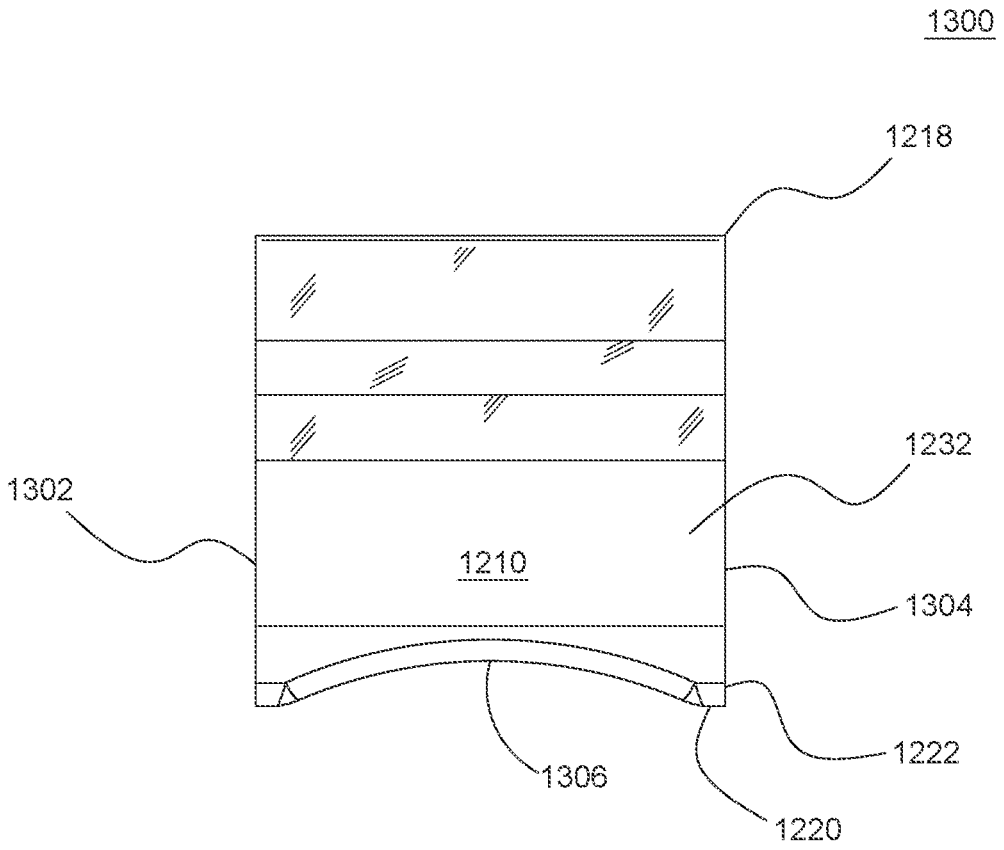
FIG. 13 is a top plan view of a chin rest having a contoured top back portion, in accordance with some embodiments.

FIG. 13 is a top plan view 1300 of a chin rest having a contoured top back portion, in accordance with some embodiments. Features of the bottom portion that would normally be in view from this orientation are not shown here for clarity of the top portion. In this example, the chin rest can be chin rest 1200 of FIG. 12. The top 1210 includes the top surface 1232 defined from the top front (or front top) edge 1218 to the top back corner transition 1222, and from a first side 1302 to the second side 1304. The back top corner 1220 extends from the first side 1302 to the second side 1304, and has a concave recess 1306, deviating inward towards the front along an arc between the first side and the second side, to provide a measure of comfort against the front of a user's neck. The back bottom corner 1214 can be likewise concave.

A chin rest has been disclosed that can be produced inexpensively, and which can provide comfortable support for a user's head, holding their chin and lower jaw up a comfortable distance from their upper chest. This avoids the problem of strain and fatigue produced by either letting the head lean forward or trying to maintain the head up without support. In particular, the shape of the chin rest lends itself to mass manufacturing using inexpensive material such that no assembly is required. A pad or cover can then be simply added if desired.

What is claimed is:

1. A chin rest comprising:

a unitary body having a first side defining a first side plane, a second side opposite the first side and defining a second side plane, a front defined from the first side plane to the second side plane, and a back opposite the front defined from the first side plane to the second side plane;

the unitary body having a bottom portion at a bottom of the unitary body, the bottom portion having a bottom surface extending from the first side plane to the second side plane, a front bottom corner defined where the bottom transitions to the front across the unitary body from the first side to the second side, a back bottom corner defined where the bottom transitions to the back across the unitary body from the first side to the second side, a bottom plane defined between front bottom corner and the back bottom corner; and the unitary body having a top portion at a top of the unitary body, the top portion having a top surface extending from the first side plane to the second side plane, a front top corner defined where the top transitions to the front across the unitary body from the first side to the second side, a back top corner defined where the top transitions to the back across the unitary body from the first side to the second side, a top plane defined between the front top corner and the back top corner;

the unitary body having a middle portion that joins the bottom portion and the top portion and that extends from the first side to the second side, and wherein the middle portion is narrower, from the front to the back than both the top portion and the bottom portion;

the bottom portion including a front bottom shoulder having a front bottom surface that meets the front bottom corner, wherein the front bottom shoulder extends forward of the middle portion such that the bottom surface extends forward of the middle portion when the bottom surface is on a user's upper chest and the top surface is on a bottom of the user's chin when the user is in a seated position with the user's head in a neutral position;

wherein the top portion is wider, from the front to the back, than the middle portion;

wherein a distance between the back top corner and the back bottom corner is less than a distance between the front top corner and the front bottom corner; and wherein the unitary body is sized to hold a head of a user of the chin rest in a neutral position while the user is seated and moderately reclined with the top portion under a chin of the user with the chin of the user on the top portion and the bottom portion on an upper chest of the user, with the back facing towards the user, the front facing away from the user.

2. The chin rest of claim 1, wherein the top plane and the bottom plane are at an angle of substantially forty five degrees with respect to each other.

3. The chin rest of claim 1, wherein the bottom surface is radiused inward from the front bottom corner to the back bottom corner.

4. The chin rest of claim 1, wherein the back top corner is rounded, and curves inward towards the front along an arc between the first side and the second side.

5. The chin rest of claim 1, wherein the first side and second side each have an I-shaped configuration.

6. The chin rest of claim 1, wherein the unitary body is made of a semi-rigid material.

7. The chin rest of claim 6, wherein the semi-rigid material is a closed cell polystyrene material.

8. The chin rest of claim 1, wherein the unitary body is made of a compliant material.

9. The chin rest of claim 1, wherein the first side is flat and second side is flat, and wherein the first side plane and the second plane are parallel.

10. A chin rest comprising:

a unitary body having a first side is flat and defines a first side plane, a second side opposite the first side that is flat and defines a second side plane, a front defined from the first side plane to the second side plane, and a back opposite the front defined from the first side plane to the second side plane, wherein the first side plane and the second side plane are parallel, ;

the unitary body having a bottom portion at a bottom of the unitary body, the bottom portion having a bottom surface extending from the first side plane to the second side plane, a front bottom corner defined where the bottom transitions to the front across the unitary body from the first side to the second side, a back bottom corner defined where the bottom transitions to the back across the unitary body from the first side to the second side, a bottom plane defined between front bottom corner and the back bottom corner, wherein the bottom surface is radiused inward from the front bottom corner to the back bottom corner; and the unitary body having a top portion at a top of the unitary body, the top portion having a top surface extending from the first side plane to the second side plane, a front top corner defined where the top transitions to the front across the unitary body from the first side to the second side, a back top corner defined where the top transitions to the back across the unitary body from the first side to the second side, a top plane defined between the front top corner and the back top corner;

the unitary body having a middle portion that joins the bottom portion and the top portion and that extends from the first side to the second side;

wherein the top portion and the bottom portion are wider, from the front to the back, than the middle portion;

wherein a distance between the back top corner and the back bottom corner is less than a distance between the front top corner and the front bottom corner; and wherein the unitary body is sized to hold a head of a user of the chin rest in a neutral position while the user is seated and moderately reclined with the top portion under a chin of the user with the chin of the user on the top portion and the bottom portion on an upper chest of the user, with the back facing towards the user, the front facing away from the user.

11. A chin rest comprising:

a unitary body having a first side defining a first side plane, a second side opposite the first side and defining a second side plane, a front defined from the first side plane to the second side plane, and a back opposite the front defined from the first side plane to the second side plane, wherein the first side and second side each have an I-shaped configuration;

the unitary body having a bottom portion at a bottom of the unitary body, the bottom portion having a bottom surface extending from the first side plane to the second side plane, a front bottom corner defined where the bottom transitions to the front across the unitary body from the first side to the second side, a back bottom corner defined where the bottom transitions to the back across the unitary body from the first side to the second side, a bottom plane defined between front bottom corner and the back bottom corner; and the unitary body having a top portion at a top of the unitary body, the top portion having a top surface extending from the first side plane to the second side plane, a front top corner defined where the top transitions to the front across the unitary body from the first side to the second side, a back top corner defined where the top transitions to the back across the unitary body from the first side to the second side, a top plane defined between the front top corner and the back top corner;

the unitary body having a middle portion that joins the bottom portion and the top portion and that extends from the first side to the second side;

wherein the top portion and the bottom portion are wider, from the front to the back, than the middle portion;

wherein a distance between the back top corner and the back bottom corner is less than a distance between the front top corner and the front bottom corner; and wherein the unitary body is sized to hold a head of a user of the chin rest in a neutral position while the user is seated and moderately reclined with the top portion under a chin of the user with the chin of the user on the top portion and the bottom portion on an upper chest of the user, with the back facing towards the user, the front facing away from the user.

* * * * *